US005181864A

United States Patent [19]

Wakino et al.

[11] Patent Number: 5,181,864

[45] Date of Patent: Jan. 26, 1993

[54] CONNECTOR

[75] Inventors: Kikuo Wakino; Iwao Fukutani, both of Nagaokakyo, Japan

[73] Assignee: Murata Manufacturing Co., Ltd., Nagaokakyo, Japan

[21] Appl. No.: 801,510

[22] Filed: Dec. 2, 1991

[30] Foreign Application Priority Data

Dec. 3, 1990 [JP] Japan ..... 2-400241

[51] Int. Cl.[5] ..... H01R 13/66

[52] U.S. Cl. ..... 439/620; 361/118; 361/119

[58] Field of Search ..... 439/620; 361/33, 111, 361/118, 119, 126, 127

[56] References Cited

U.S. PATENT DOCUMENTS 5,008,770 4/1991 Hilland ..... 439/620 X
5,099,380 3/1992 Childers et al. ..... 439/620 X

FOREIGN PATENT DOCUMENTS 0194424 9/1986 European Pat. Off. ..... 439/620

*Primary Examiner*—Eugene F. Desmond
*Attorney, Agent, or Firm*—Burns, Doane, Swecker & Mathis

[57] ABSTRACT

A connector comprising a housing having a varistor-characteristic resin portion, and signal coupling terminal conductors which penetrate the varistor-characteristic resin portion. The housing itself is made of a varistor-characteristic resin material or the housing is fitted, at its side recess portion, with the varistor-characteristic resin material.

17 Claims, 3 Drawing Sheets

CONNECTOR

BACKGROUND OF THE INVENTION

1. Field of the Invention

The present invention relates to a connector, and in particular to the connector which connects electrically an electronic instrument such as a telephone and a facsimile to a network line.

2. Description of Related Art

A connector which electrically connects an electronic instrument such as a telephone to a network line may be associated with a varistor (a nonlinear voltage characteristic resistor) in order to protect the electronic instrument against noise and surge (excessive voltages up to the order of a few kilo-volts to several tens of kilo-volt).

Both the connector and the varistor have been produced as two discrete parts, and, thus, the varistor needs mounting onto any of signal coupling terminal conductors on the connector housing. Mounting the varistor is a troublesome step. Also, the varistor needs space to mount it in the connector, presenting a difficulty in miniaturization of the electronic instrument.

SUMMARY OF INVENTION

An object of the present invention is therefore to provide a compact, easy-to-manufacture connector having a varistor capability to protect an electronic instrument against noise and surge.

To achieve the above object, a connector according to the present invention comprises a housing having a resin portion which is provided with a varistor capability, and a signal coupling terminal conductor which penetrates the resin portion having the varistor capability. The housing itself is made of a varistor-characteristic resin material or the housing is fitted, at its side recess portion, with the varistor-characteristic resin material. The signal coupling terminal conductor serves as a contact to be connected to the mating plug and/or as a coupling pin to be connected to an electrical circuit board. The varistor-characteristic resin material is, for example, a compound made up of a resin material (such as epoxy resin, polyvinyltelephtalate, nylon or the like) as a base material with varistor-characteristic semiconductor powder (such as SiC, ZnO, $SrTiO_3$ or the like) of about 50–90% by weight.

In the above-mentioned structure, the connector housing has already varistor characteristics, and no further varistor needs attaching later, allowing the mounting step to be eliminated in the production process. Also, no extra space for the varistor is needed.

BRIEF DESCRIPTION OF THE DRAWINGS

This and other objects and features of the present invention will become apparent from the following description in connection with preferred embodiments thereof in reference to the accompanying drawings in which.

DETAILED DESCRIPTION OF THE PREFERRED EMBODIMENTS

Figure 1:
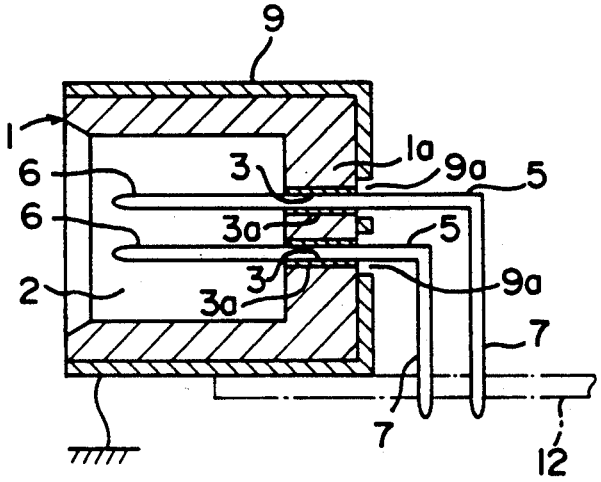
FIG. 1 is an elevational view in section showing a first embodiment of a connector according to the present invention.

Referring now to the drawings, some embodiments of the connector according to the present invention are described below. The same reference numerals are commonly used throughout the drawings and the description of the embodiments that follow, if any components and portions are identical.

Figure 2:
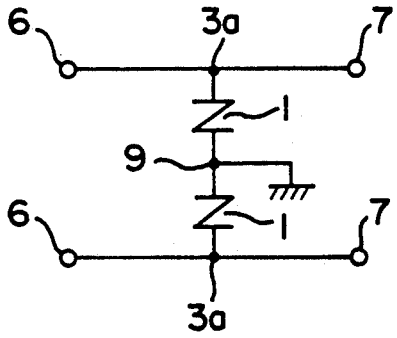
FIG. 2 is a schematic diagram showing an electrical equivalent circuit of the connector shown in FIG. 1.

First Embodiment: FIGS. 1 and 2

In FIG. 1, the connector comprises an insulating housing 1, two signal coupling terminal conductors 5 secured to the housing 1, a grounding plate 9 covering the housing 1.

The signal coupling terminal conductors 5 have, at one end, contact portions 6, which are to be electrically connected to a plug of a network line, and, at the other end, coupling pin portions 7, which are to be electrically connected to an electrical circuit board 12 built in an electrical instrument such as a telephone. The signal coupling terminal conductors 5 may be a resilient, good conductor material such as phosphor bronze.

The housing 1 has an opening 2 on the left side in FIG. 1. The signal coupling terminal conductors 5 are inserted into through holes 3 disposed on a side wall 1*a* of the housing 1. With the contact portions 6 projected into the opening 2 and the coupling pin portions 7 projected outward from the housing 1, the signal coupling terminal conductors 5 are soldered to electrodes 3*a* provided on the inner walls of the through holes 3. The mating plug is inserted into the opening 2, to be pressed against the contact portions 6. Employed as a material of the housing 1, for example, is a compound made up of a resin material (such as epoxy resin, polyvinyltelephtalate, nylon or the like) as a base material with varistor-characteristic semiconductor powder (such as SiC, ZnO, $SrTiO_3$ or the like) of about 50–90% by weight. Preferably, the grain diameter of the semiconductor powder is between about 10 μm and 50 μm. The addition of small amount of metal powder such as Ni powder allows varistor voltage of the compound to lower.

The grounding plate 9 has an opening 9*a*, through which the signal coupling terminal conductors 5 pass without contacting the grounding plate 9. The grounding plate 9, which is electrically grounded, is fitted onto the housing 1 to generally cover it. The grounding plate 9 may be of metal, such as Cu, Al or the like.

FIG. 2 is a schematic diagram showing an electrical equivalent circuit of the above-mentioned connector. Noise and surge which come in through the contact portions 6 of the signal coupling terminal conductors 5 are attenuated by means of the housing 1 with its varistor characteristics. The noise and surge are suppressed at the coupling pin portions 7 to the extent that their levels are not significant any more. The circuit of the electrical instrument, such as a telephone, connected to the coupling pin portions 7, is thus protected.

Also, since the housing 1 has already varistor characteristics, no additional varistors are required. Miniaturization of the connector is thus effectively achieved.

Figure 3:
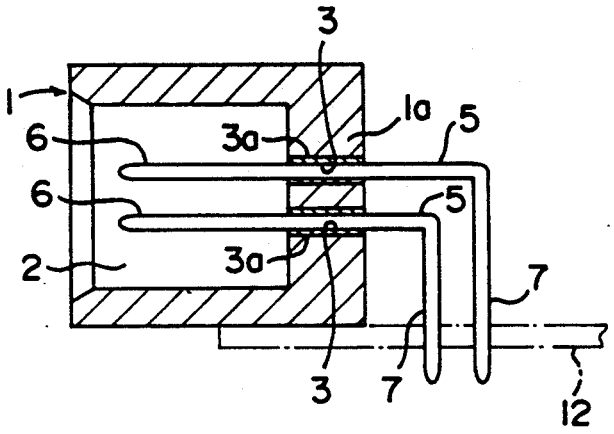
FIG. 3 is an elevational view in section showing a second embodiment of a connector according to the present invention.
Figure 4:
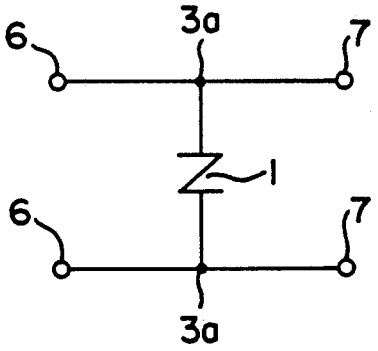
FIG. 4 is a schematic diagram showing an electrical equivalent circuit of the connector shown in FIG. 3.

Second Embodiment: FIGS. 3 and 4

A connector illustrated in FIG. 3 has no grounding plate 9. The rest of the connector is identical to the connector of the first embodiment mentioned above. Although this connector of the second embodiment exhibits slightly less reliable electrical characteristics between the signal coupling terminal conductors 5, its production is less costly. FIG. 4 is a schematic diagram showing an electrical equivalent circuit of the connector.

Figure 5:
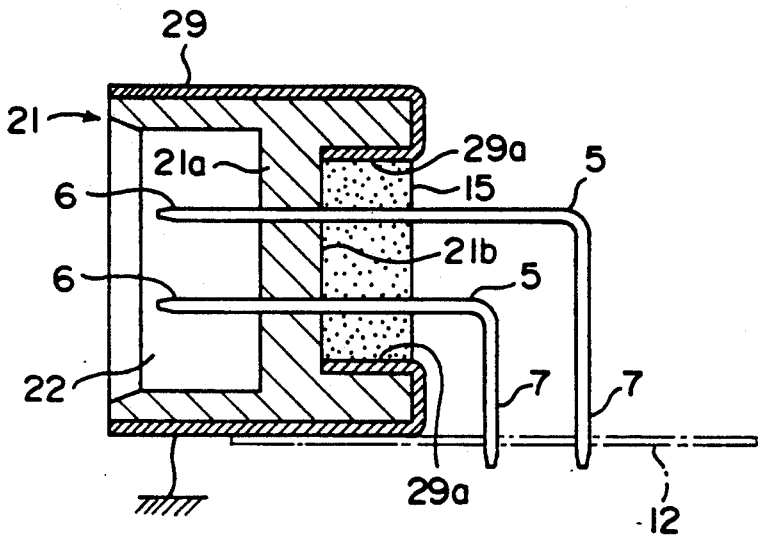
FIG. 5 is an elevational view in section showing a third embodiment of a connector according to the present invention.

Third Embodiment: FIG. 5

A connector illustrated in FIG. 5 uses a resin portion with varistor characteristics, as part of the housing, rather than as completely integral part of the housing.

More specifically, the connector has, on its side wall 21*a* of a housing 21, a recess portion 21*b* on the opposite side of a opening 22, into which the mating plug is inserted. The signal coupling terminal conductors 5 are fitted into the side wall 21*a* of the housing 21 by using an insert molding method. A grounding plate 29 is fitted so that its bent portion 29*a* is attached to the wall of the recess portion 21*b*.

The resin material 15 with varistor characteristics is injected, in its molten state, into the recess portion 21*b*. Employed as a material of the varistor-characteristic resin 15 is, like the first embodiment already mentioned, a compound made up of a resin material, such as epoxy resin, polyvinyltelephtalate, nylon or the like, as a base material with varistor-characteristic semiconductor powder, such as SiC, ZnO, $SrTiO_3$ or the like. The housing 21 may be of any type of an insulating resin.

The equivalent circuit of the third embodiment is, in principle, identical to that of the first embodiment. The electrical effect of suppressing noise and surge is thus almost identical between both embodiments. In the third embodiment, the housing 21 and the varistor-characteristic resin 15 are manufactured in separate manufacturing processes before both are assembled; thus, most appropriate materials may be individually selected, considering their suitability for each of the housing 21 and the varistor-characteristic resin 15. For example, a high rigidity resin material may be selected for the housing 21.

Figure 6:
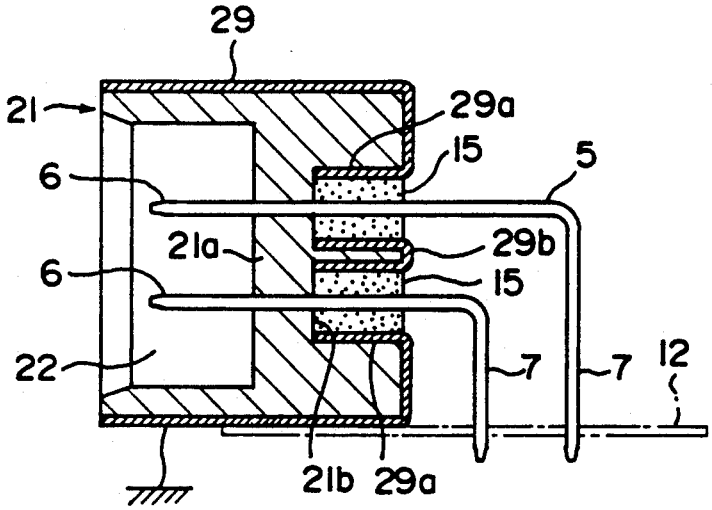
FIG. 6 is an elevational view in section showing a fourth embodiment of a connector according to the present invention.

Fourth Embodiment: FIG. 6

A connector illustrated in FIG. 6 is a variation of the connector illustrated in FIG. 5. In FIG. 6, a housing 29 is fitted with a split wall 29*b* which splits the recess portion 21*b* of the housing 21 into two portions. Each of split recess portions, allowing each of the signal coupling terminal conductors 5 to pass through, is filled with the varistor-characteristic resin 15.

The advantage and the electrical equivalent circuit of the fourth embodiment are respectively identical to those of the third embodiment.

Other Embodiments

Although the present invention has been described in connection with the preferred embodiments above, it is to be noted that various changes and modifications are apparent to those are to be understood as being within the scope of the present invention defined by the appended claims.

In the above description, the number of the signal coupling terminal conductors are two. If the number of the network lines increase, the number of the signal coupling terminal conductors may be increased accordingly.

Furthermore, in the first and second embodiments, the signal coupling terminal conductors 5 are not necessarily soldered to the electrodes 3 inside the through holes 3 in the housing 1. Alternatively, the signal coupling terminal conductors 5 may be fixed into the housing 1 by the insert molding method, in the molding process of the housing 1.

Furthermore, in the third and fourth embodiments, electrodes may be fitted between the signal coupling terminal conductors 5 and the varistor-characteristic resin 15.

Furthermore, in the third and fourth embodiments, the grounding plate 29 may be removed.

What is claimed is:

1. A connector comprising:

a housing which is made of a varistor-characteristic resin material; and a signal coupling terminal conductor which penetrates a side wall of said housing.

2. A connector as claimed in claim 1, further comprising a grounding plate, covering said housing but remaining noncontact with said signal coupling terminal conductor.

3. A connector as claimed in claim 2, wherein said signal coupling terminal conductor is kept in contact with said side wall by means of an electrode.

4. A connector as claimed in claim 3, wherein said signal coupling terminal conductor is formed of phosphor bronze.

5. A connector as claimed in claim 4, wherein said varistor-characteristic resin material includes a base material selected from the group consisting of epoxy resin, polyvinyltelephtalate or nylon.

6. A connector as claimed in claim 5, wherein said varistor-characteristic resin material is further composed of a powder selected from the group consisting of SiC, ZnO or $SrTiO_3$.

7. A connector as claimed in claim 6, wherein said powder constitutes about 50 to 90% by weight of the varistor-characteristic resin material.

8. A connector as claimed in claim 7, wherein said powder is granular having a diameter of approximately 10 $\mu$m to 50 $\mu$m.

9. A connector as claimed in claim 1, wherein said signal coupling terminal conductor is kept in contact with said side wall by means of an electrode.

10. A connector as claimed in claim 9, wherein said signal coupling terminal conductor is a plurality of terminal conductors which penetrate said varistor-characteristic resin material.

11. A connector comprising:

a housing which is made of an insulating resin material;

a varistor-characteristic resin material, wherein said varistor-characteristic resin material is injected into a recess portion disposed on a side wall of said housing, and a signal coupling terminal conductor which penetrates the side wall of said housing and said varistor-characteristic resin material.

12. A connector as claimed in claim 11, further comprising a grounding plate, covering said housing but remaining noncontact with said signal coupling terminal conductor.

13. A connector as claimed in claim 12, wherein said signal coupling terminal conductor is kept in contact with said side wall by means of an electrode, said signal coupling terminal conductor being formed of phosphor bronze, and said varistor-characteristic resin material including a base material selected from the group consisting of epoxy resin, polyvinyltelephtalate or nylon.

14. A connector as claimed in claim 13, wherein said varistor-characteristic resin material is further composed of a powder selected from the group consisting of SiC, ZnO or $SrTiO_3$.

15. A connector as claimed in claim 14, wherein said powder constitutes about 50 to 90% by weight of the varistor-characteristic resin material.

16. A connector as claimed in claim 15, wherein said powder is granular having a diameter of approximately 10 $\mu$m to 50 $\mu$m.

17. A connector as claimed in claim 16, wherein said signal coupling terminal conductor is a plurality of terminal conductors which penetrate said varistor-characteristic resin material.

* * * * *